US008468730B2

(12) United States Patent
Faifer et al.

(10) Patent No.: US 8,468,730 B2
(45) Date of Patent: Jun. 25, 2013

(54) AMMUNITION MAGAZINE

(76) Inventors: Sagi Faifer, Mishmar Hashiva (IL); Yehuda Meller, Rishon Lezion (IL)

( * ) Notice: Subject to any disclaimer, the term of this patent is extended or adjusted under 35 U.S.C. 154(b) by 255 days.

(21) Appl. No.: 12/987,177

(22) Filed: Jan. 10, 2011

(65) Prior Publication Data

US 2011/0167695 A1 Jul. 14, 2011

(30) Foreign Application Priority Data

Jan. 10, 2010 (IL) ..... 203225

(51) Int. Cl.
*F41A 9/61* (2006.01)

(52) U.S. Cl.
USPC ..... 42/50; 42/87

(58) Field of Classification Search
USPC ..... 42/50, 87–88; 89/34, 33.1
See application file for complete search history.

(56) References Cited

U.S. PATENT DOCUMENTS

| | | | | | |
|---|---|---|---|---|---|
| 1,307,492 | A * | 6/1919 | Hammond | 42/7 |
| 1,500,580 | A * | 7/1924 | Fererro | 42/50 |
| 3,736,686 | A * | 6/1973 | Moller et al. | 42/6 |
| 4,430,821 | A * | 2/1984 | Vincent | 42/50 |
| 4,688,344 | A * | 8/1987 | Kim | 42/50 |
| 4,831,761 | A * | 5/1989 | Kulakow | 42/50 |
| 5,291,679 | A * | 3/1994 | Wollack et al. | 42/50 |
| 7,200,964 | B2 * | 4/2007 | Gates | 42/50 |
| 8,234,810 | B2 * | 8/2012 | Lee, III | 42/87 |
| 2005/0150148 | A1 * | 7/2005 | Herpel | 42/50 |
| 2005/0188579 | A1 * | 9/2005 | Gates | 42/50 |
| 2012/0030987 | A1 * | 2/2012 | Lee, III | 42/87 |

* cited by examiner

*Primary Examiner* — Michelle Clement

(74) *Attorney, Agent, or Firm* — Deborah Gador

(57) ABSTRACT

An ammunition magazine including a housing having a base, a follower spring-biased in the housing against the base, a belt coupled to the follower for pulling the follower towards the base, a belt collecting and release mechanism mounted in the base, the belt being coupled to the mechanism for shortening the belt around the wheel when the magazine is rolled along a surface in a forward direction, whereby the belt pulls the follower into the magazine to permit loading of cartridges into the magazine, and for preventing rotation of the wheel to release the belt when the base is rolled along a surface in a rearward direction.

12 Claims, 13 Drawing Sheets

AMMUNITION MAGAZINE

FIELD OF THE INVENTION

The present invention relates to ammunition magazines, in general, and, in particular, to devices for aiding in loading cartridges in ammunition magazines.

BACKGROUND OF THE INVENTION

Manual loading of cartridges in ammunition magazines in general, and in rifle magazines in particular, is time consuming and painful for the fingers. In addition, over time, the conventional loading method causes deformation of the lips of the magazine which, in turn, can cause problems feeding cartridges from the magazine into the chamber of the firearm.

There are known several devices for aiding the loading of cartridges into magazines. Many of these devices include cover elements adapted to be mounted on a magazine for manual motion relative to the magazine to depress the cartridges in the magazine and make space for an added cartridge.

Others provide insertion of the magazine from the side of the device, without means for retaining the magazine other than the user's hand, or include complex levers with cams for rotational motion.

Accordingly, there is a long felt need for a relatively simple but comfortable loading device for use with an ammunition magazine, and it would be very desirable to have such a device which can be built-in in the magazine.

SUMMARY OF THE INVENTION

The present invention relates to an ammunition magazine having an accessory for aiding loading cartridges that is an integral part of the magazine, substantially without affecting its size or function.

There is provided according to the present invention an ammunition magazine including a housing having a base; a spring-biased follower, a belt coupled to the follower to pull the follower towards the base, a mechanism in the base coupled to the belt for pulling the follower into the magazine, towards the base selectively causing the belt to pull said follower towards the base to permit freely loading of cartridges into the magazine.

According to a preferred embodiment of the invention, the mechanism includes a toothed wheel arranged for selectable rolling along a surface and coupled to the belt for winding the belt around the wheel to pull the follower towards the base when the wheel rolls along a surface in a forward direction, and a locking arm pivotally coupled to said base for selectably engaging teeth on the toothed wheel and preventing rotation of the wheel to unwind the belt from the wheel.

According to one embodiment of the invention, the locking arm is spring-biased in the base for selectably engaging teeth of the toothed wheel so as to prevent rotation of the wheel to unwind the belt from the wheel when the base of the magazine is rolled along a surface in a rearward direction and for selectably releasing the teeth so as to permit rotation of the wheel to unwind the belt from the wheel when the base does not contact a surface.

There is also provided a retrofit kit for an ammunition magazine, the kit including a replacement follower, a replacement base for the magazine, a belt coupled to the base and to the follower for pulling the follower towards the base, and a mechanism in the base coupled to the belt for selectively causing the belt to pull the follower towards the base to permit freely loading of cartridges into the magazine.

According to one embodiment, the mechanism includes a toothed wheel mounted in the base for selectable rolling along a surface, the belt being coupled to the wheel for winding the belt around the wheel to pull the follower towards the base when the wheel rolls along a surface in a forward direction, and a locking arm pivotally coupled to the base for selectably engaging teeth on the toothed wheel and preventing rotation of the wheel to unwind the belt from the wheel.

There is further provided according to the invention, a method for forming an ammunition magazine, the method including providing a magazine housing, mounting a removable base on the housing, mounting a follower in the housing spring-biased against the base, coupling a belt to the follower for pulling the follower towards the base, and mounting a mechanism in the base for causing the belt to pull the follower towards the base to permit freely loading of cartridges into the magazine, and coupling said mechanism to said belt.

According to a preferred embodiment, the step of mounting a mechanism includes mounting a toothed wheel in the base, arranged for selectable rolling along a surface, mounting a toothed wheel in the base, affixing one end of a belt to the toothed wheel, and pivotally coupling an arm to the base for selective engagement of teeth on the wheel.

According to one embodiment, the step of coupling the belt to the follower includes affixing the second end of the belt to the follower.

According to an alternative embodiment, the step of coupling the belt to the follower includes affixing a pulley to the follower, passing the belt over the pulley, and affixing the second end of the belt to the base.

BRIEF DESCRIPTION OF THE DRAWINGS

The present invention will be further understood and appreciated from the following detailed description taken in conjunction with the drawings in which.

DETAILED DESCRIPTION OF THE INVENTION

The present invention relates to ammunition magazines incorporating an accessory for aiding in loading cartridges into the magazine. The accessory is an integral part of the magazine, and includes a mechanism in the bottom of the magazine housing, and a belt coupling the mechanism to the follower of the magazine, whereby collection of the belt by the mechanism pulls the follower into the magazine towards the base, and release of the belt releases the spring-biased follower. Preferably, the mechanism includes a gear or ratchet wheel cooperating with a pivotal arm in the base, whereby rotation of the wheel, by rolling the magazine along a surface, causes contraction of the spring-biased follower inside the magazine housing while release of the magazine from the surface permits the follower to extend and push the cartridges in the magazine towards the firearm.

Figure 1:
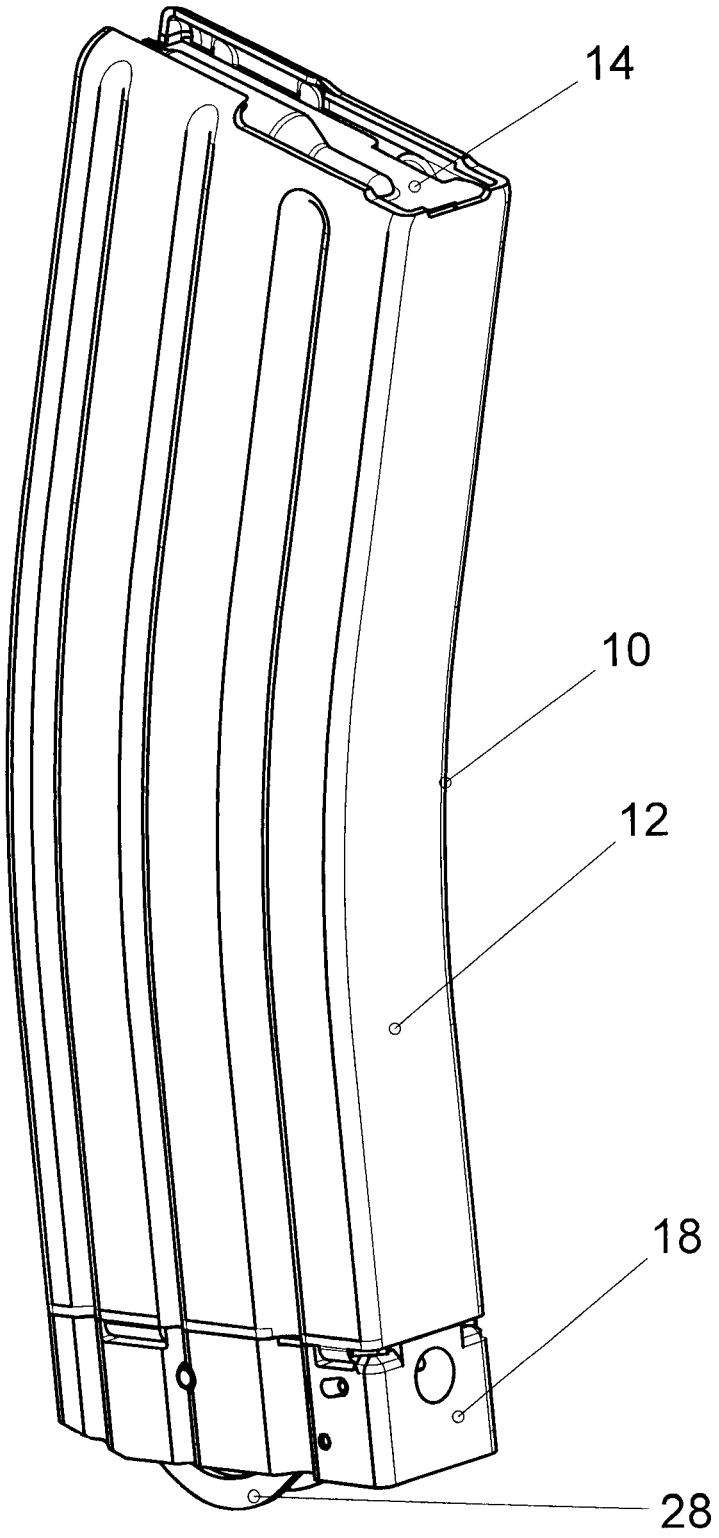
FIG. 1 is an isometric illustration of an ammunition magazine, constructed and operative in accordance with one embodiment of the present invention, for a rifle, particularly a M16 or AR15 rifle.
Figure 2:
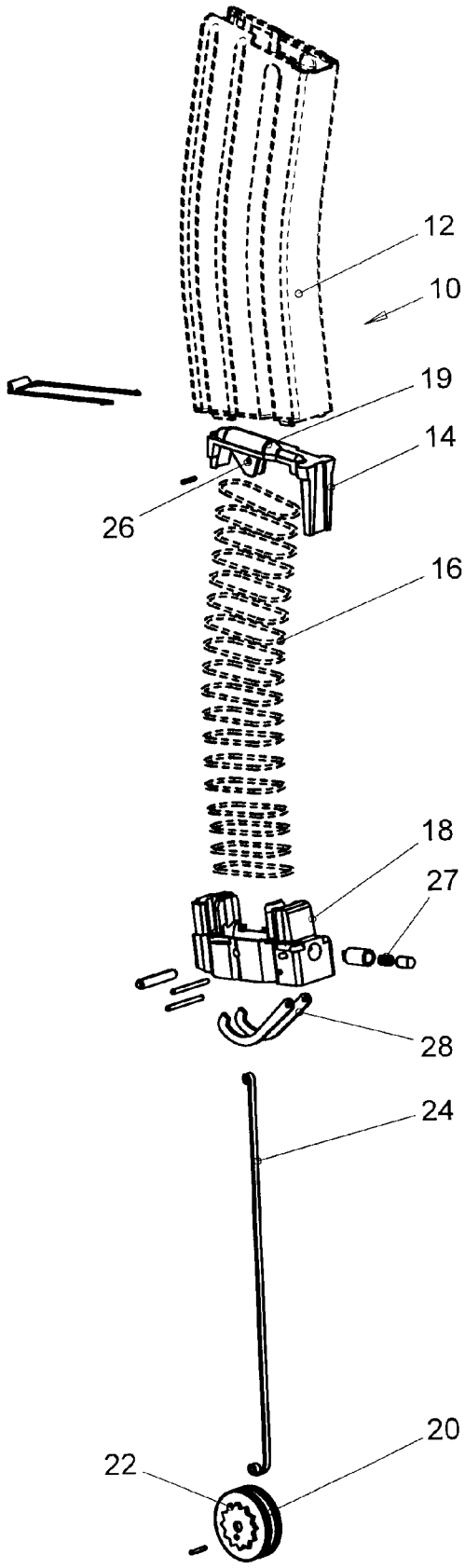
FIG. 2 is an exploded illustration of the magazine of FIG. 1.

FIG. 1 is an isometric illustration and FIG. 2 is an exploded illustration of an ammunition magazine 10, constructed and operative in accordance with one embodiment of the present invention, particularly suited for use with an M16 or any other rifle that is fed by a magazine. Magazine 10 is substantially a conventional magazine, including a housing 12 and a follower 14 biased by a spring 16 seated on a base 18 of housing 12. Follower 14 is a conventional follower for engaging and supporting a plurality of cartridges (not shown) inside housing 12.

The magazine 10 of the present invention differs from conventional magazines in that the base 18 is removable and supports a mechanism for collecting and releasing a belt coupled to the magazine follower. Collecting the belt in the base pulls the magazine follower towards the base, thereby making space available in the top open end of the magazine for insertion of bullets. Releasing the belt permits the spring to urge the follower away from the base.

According to one embodiment, the mechanism includes a gear wheel or ratchet wheel 20 having a plurality of teeth 22. Magazine 10 further includes a belt 24 affixed to wheel 20 and adapted to wrap around wheel 20. Follower 14 includes one or more depending lugs 26 adapted to lockingly engage belt 24. Two arms 28 are pivotally coupled to base 18 and selectably engage teeth 22 of wheel 20. Arms 28 are spring biased against a spring 29 in a groove 25 in base 18 for pivotal and axial movement. As can be seen, spring 29 urges arms 28 along groove 25 towards engagement with teeth 22 of wheel 20. Preferably, base 18 defines a slanted outer surface 29 for sliding along a surface during loading of cartridges, as described in detail below.

Figure 3A:
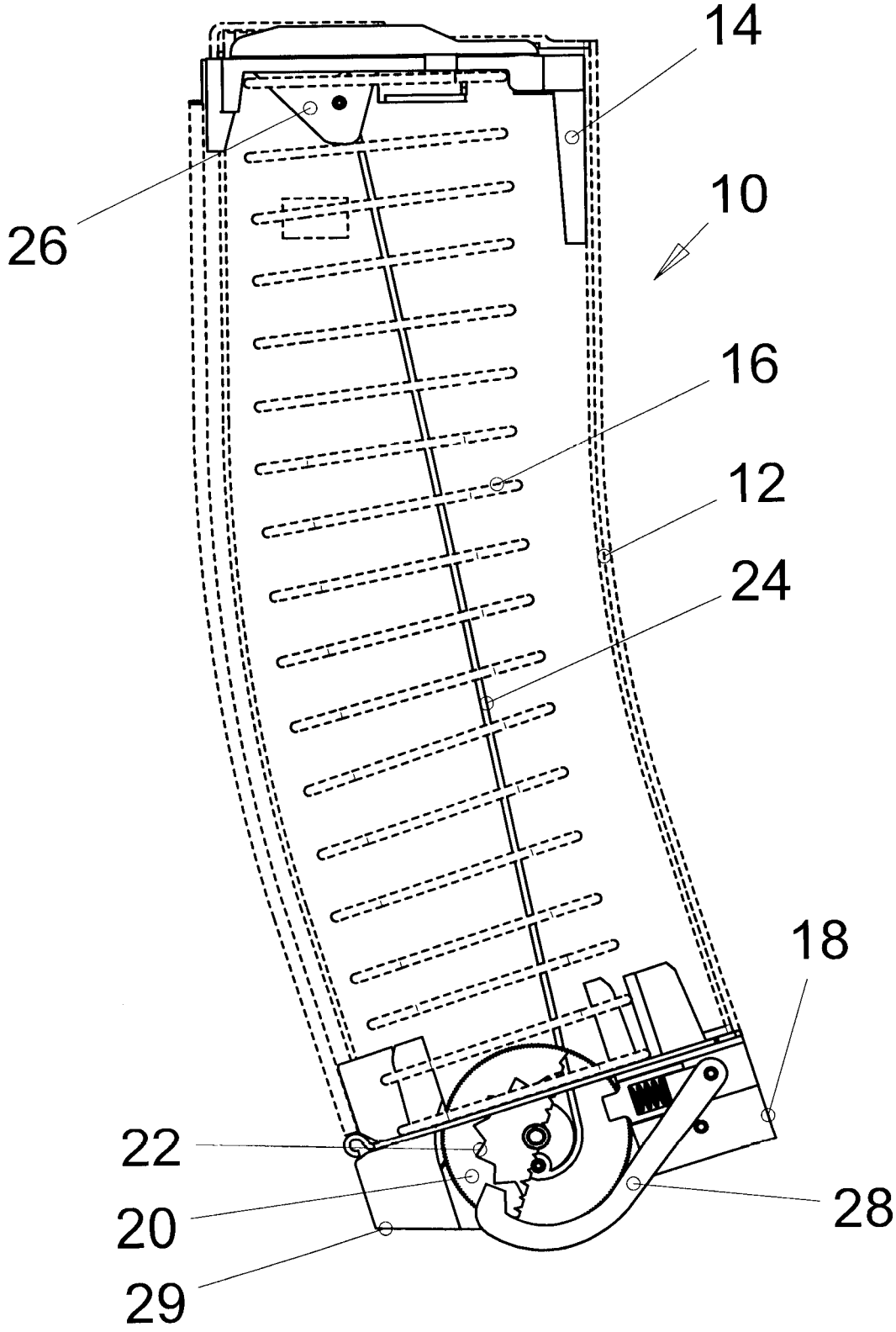
FIG. 3*a* is a sectional illustration of the magazine of FIG. 1 in a substantially empty orientation.

The loading operation of magazine 10 will now be described with reference to FIGS. 3*a* to 3*e*. FIG. 3*a* is a sectional illustration of the magazine 10 of FIG. 1 in a substantially empty orientation. As can be seen, spring 16 is substantially completely extended within housing 12. Belt 24 is affixed, at one end, to lugs 26 of follower 14, and at the other end, about wheel 20. In this orientation, with the magazine in the air, arms 28 can pivot somewhat out of base 18, and wheel 20 can rotate freely in either direction, without engaging teeth 22.

Figure 3B:
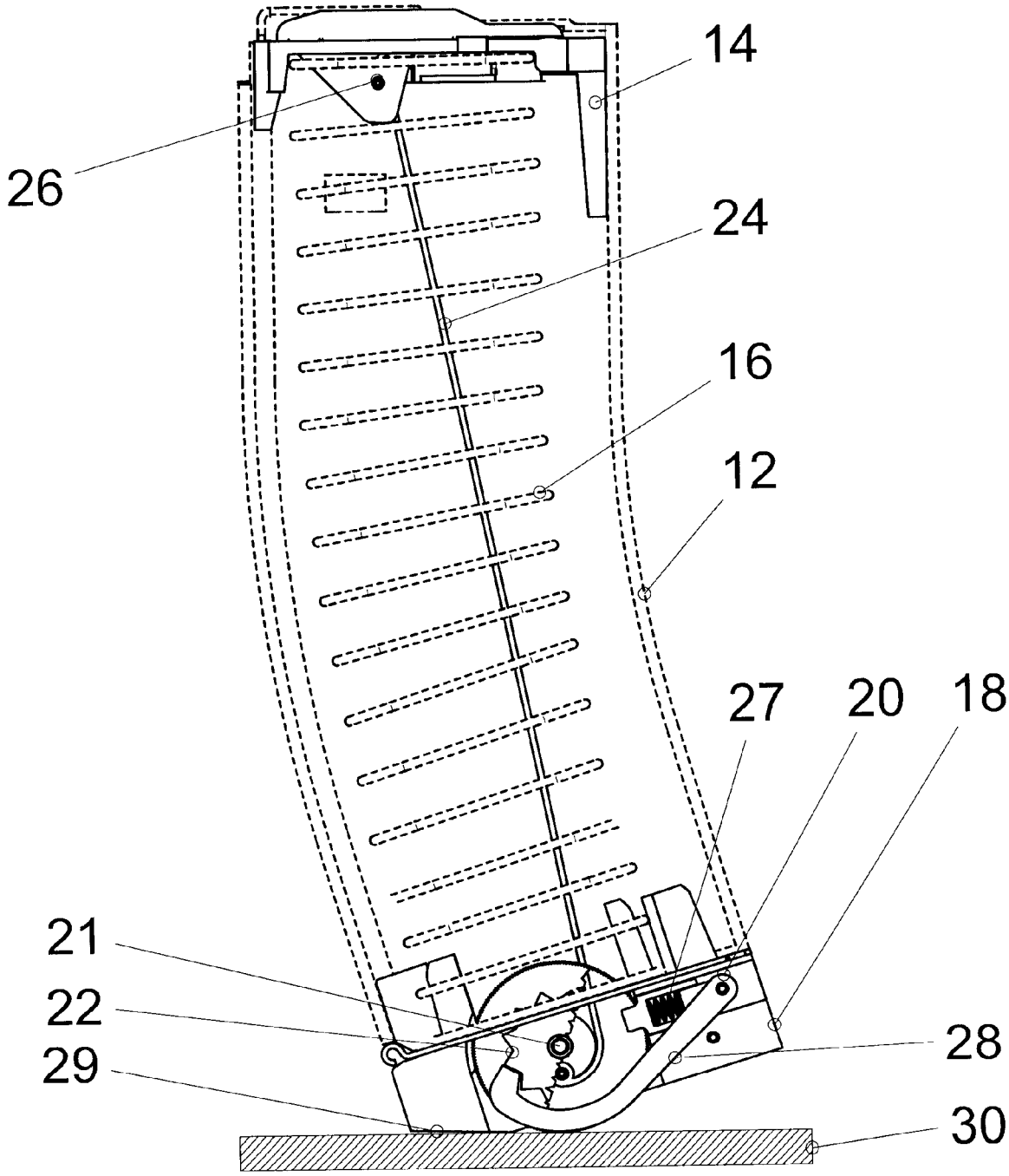
FIG. 3*b* is a sectional illustration of the magazine of FIG. 1 in a pre-loading orientation.

When it is desired to load cartridges into the magazine, as shown in FIG. 3*b*, housing 12 is pressed down onto a surface 30, until slanted outer surface 29 of base 18 engages surface 30. Surface 30 can be any surface providing sufficient friction to permit wheel 20 to roll. As can be seen, pressing the magazine on surface 30 causes arms 28 to pivot into base 18 and engage teeth 22 of wheel 20 under the urging of spring 27.

Figure 3C:
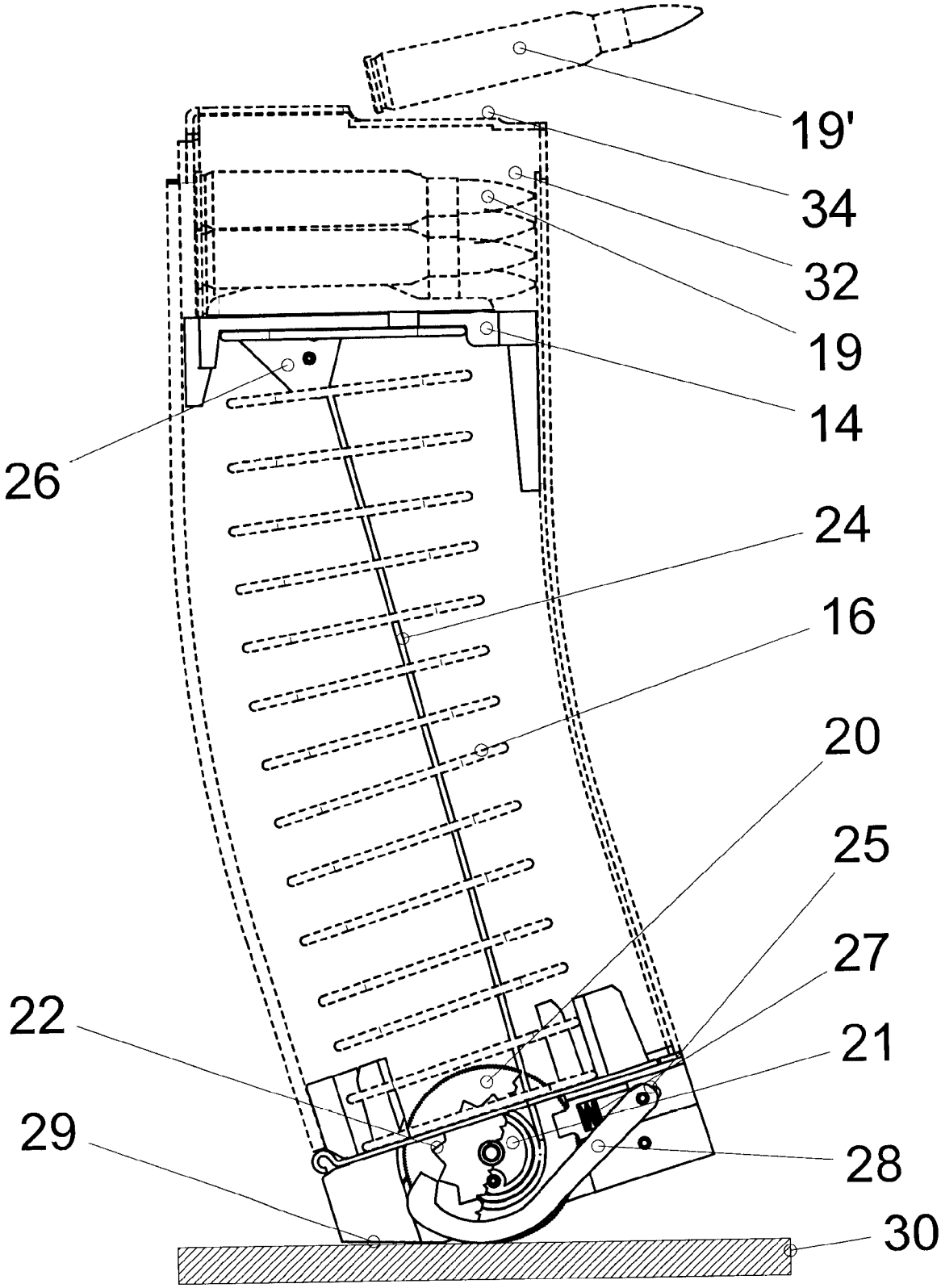
FIG. 3*c* is a sectional illustration of the magazine of FIG. 1 in a loading orientation while rolling the magazine forwards.

Magazine 10 is now rolled on wheel 20 forwards along surface 30, in the direction of the arrow shown in FIG. 3*c*. As wheel 20 rotates, belt 24 is wound around the axle 21 of wheel 20, thereby pulling follower 14 against the action of spring 16, and tensioning spring 16. As follower 14 is pulled into housing 12, an empty space 32 is formed above follower 14 and within lips 34 of the housing, into which additional cartridges 19' can rapidly be inserted with little or no effort. It will be appreciated that, as wheel 20 rotates, teeth 22 of wheel 20 push arms 28 outwards in groove 25 against the urging of spring 27, thereby preventing engagement and locking of wheel 20.

Figure 3D:
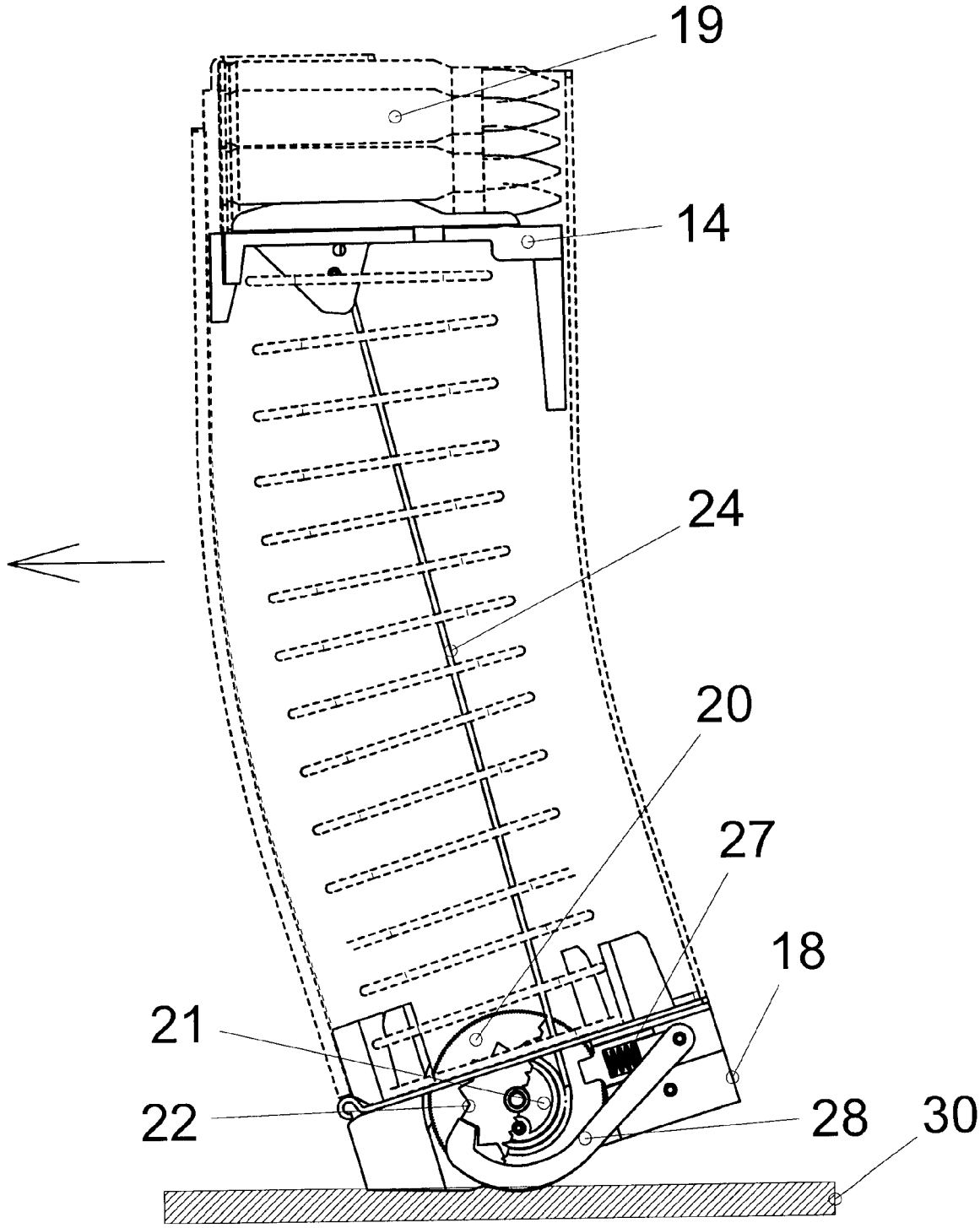
FIG. 3*d* is a sectional illustration of the magazine of FIG. 1 while rolling the magazine backwards.

It is a feature of the invention that, if the magazine is moved along surface 30 in the opposite direction, while a user is still loading cartridges, as shown in FIG. 3*d*, spring 27 urges arms 28 to slide inwards in groove 25 and to pivot towards teeth 22 so that arms 28 engage the teeth, thereby stopping rotation of wheel 20. In this way, unwinding of belt 24 from axle 21 and the release of follower 14 are prevented.

Figure 3E:
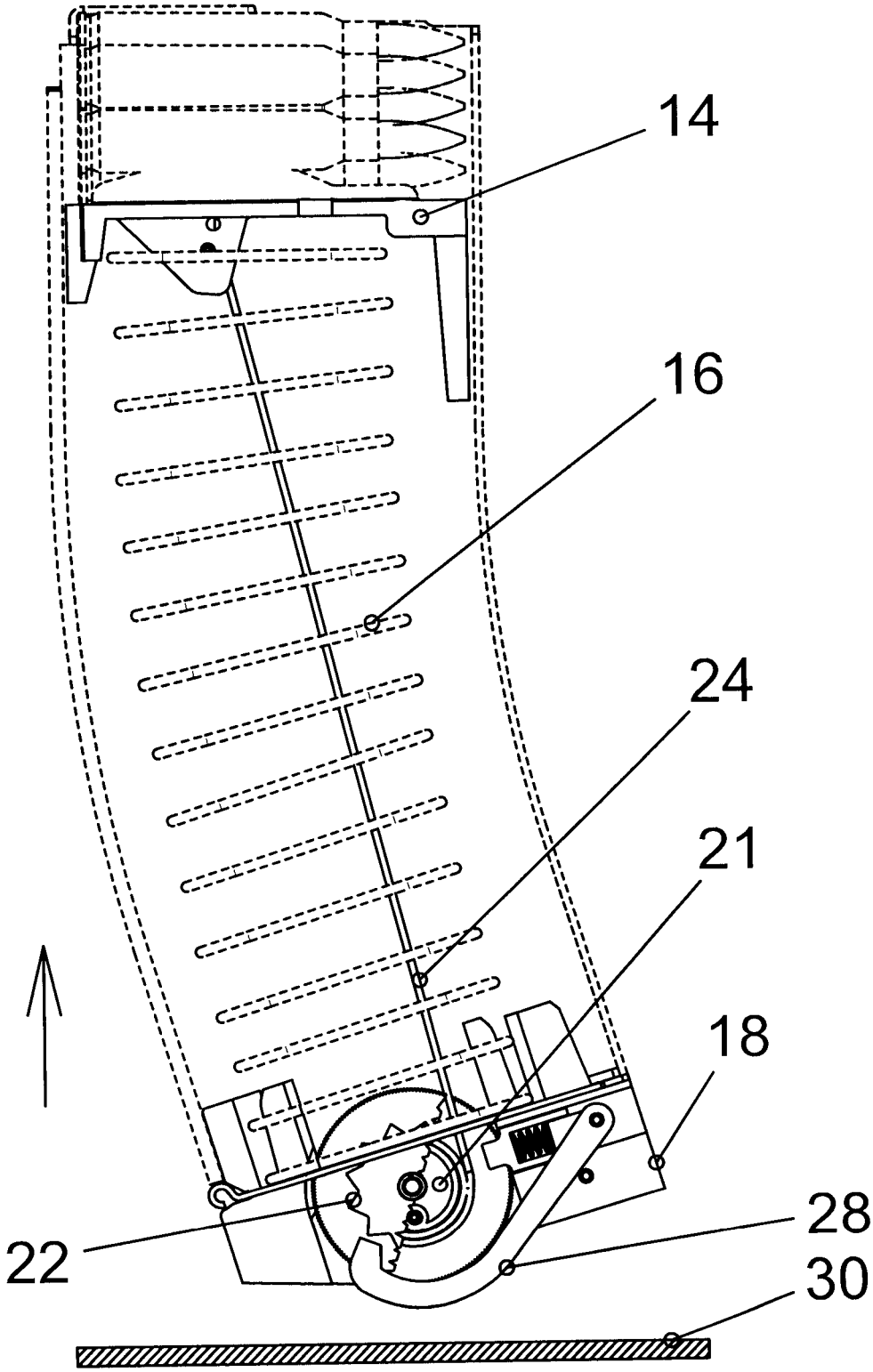
FIG. 3*e* is a sectional illustration of the magazine of FIG. 1 in a loaded orientation.

On the other hand, it is crucial that belt 24 unwind from axle 21 during firing of the firearm, so that follower 14 can push cartridges 19 into the firearm. Accordingly, when the magazine 10 has been loaded and is raised from surface 30 and inserted into the magazine well, as seen in FIG. 3*e*, arms 28 pivot out of base 18 of housing 12 and are pulled inwards in groove 25, disengaging from teeth 22 of wheel 20, so that wheel 20 is free to rotate in either direction. Under the urging of spring 16, follower 14 will be urged upwards towards cartridges 19, unrolling belt 24 as it moves.

It is a particular feature of the invention, as can be seen in FIG. 1, that magazine 10 is not substantially longer than a conventional magazine for an M16, and the pivotal arms 28 extend only a small amount beneath the base 18. Furthermore, the invention can be implemented as a retrofit kit for existing magazines. In this case, most of the parts of the conventional magazine can be retained and utilized. What must be replaced are the follower and the base of the magazine. The wheel and belt must then be added.

Figure 4:
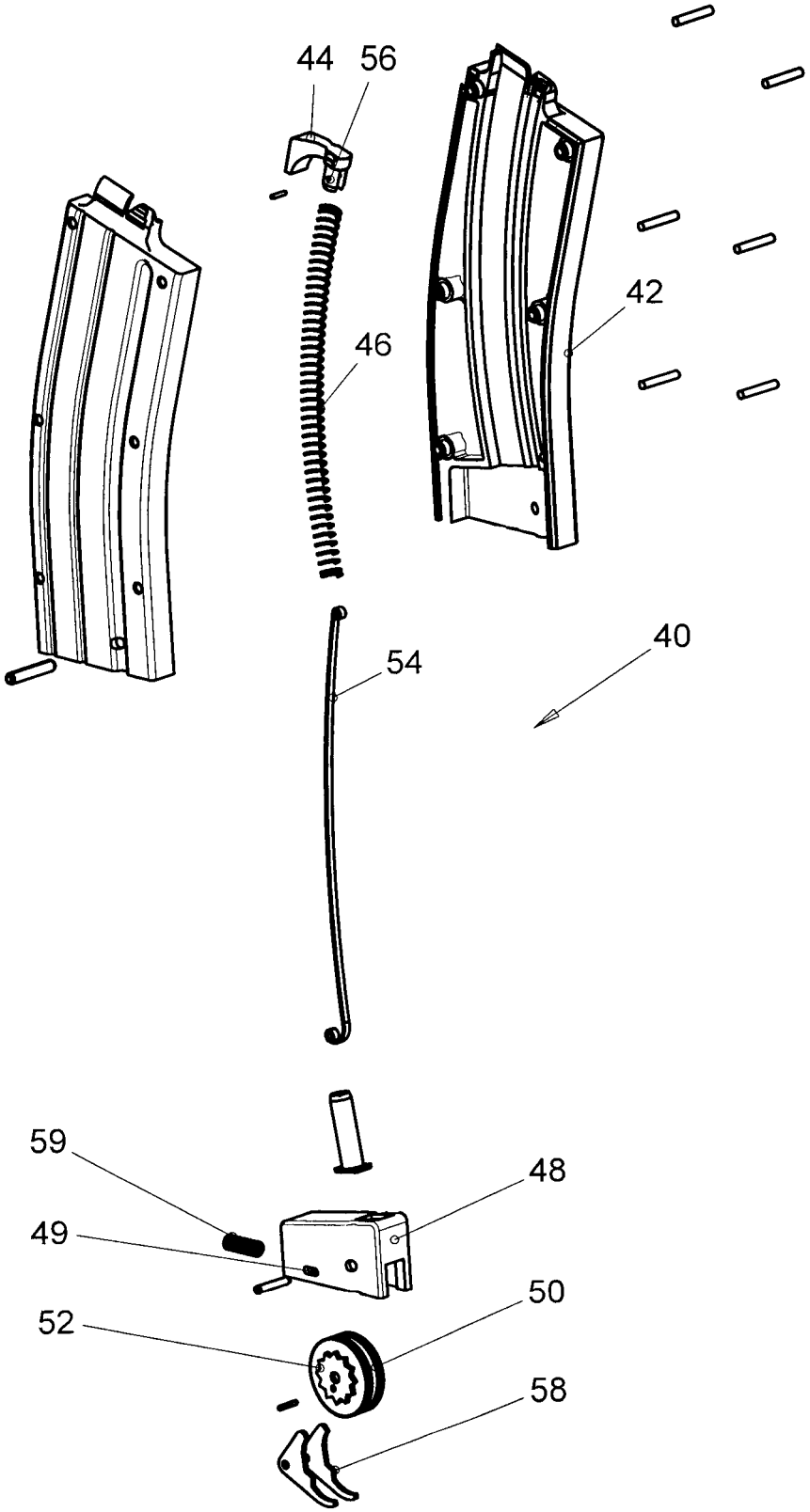
FIG. 4 is an exploded illustration of an ammunition magazine, constructed and operative in accordance with another embodiment of the present invention, for a 0.22 caliber firearm.

FIG. 4 is an exploded illustration of an ammunition magazine 40, constructed and operative in accordance with another embodiment of the present invention, particularly for use with a 0.22 caliber firearm. Magazine 40 has the outer shape of a 5.56 caliber magazine although it is arranged internally to carry 0.22 caliber rounds. Magazine 40 is substantially similar to magazine 10 of FIG. 1 and has a similar mechanism for collecting and releasing the belt. However, due to the size and shape of magazine 40 and of the 0.22 caliber rounds, the follower, the base and the pivoting arms are of a different design. As can be seen in FIG. 4, magazine 40 includes a housing 42 and a follower 44 biased by a spring 46 seated on a base 48 of housing 42. Follower 44 is a conventional follower for engaging and supporting a plurality of cartridges (not shown) inside housing 42.

Base 48 is removable and supports a gear wheel or ratchet wheel 50 having a plurality of teeth 52. Magazine 40 further includes a belt 54 threaded through spring 46 and affixed to wheel 50. Belt 54 is adapted to wrap around the axle of wheel 50. Follower 44 includes one or more depending lugs 56 adapted to lockingly engage belt 54. Two arms 58 are spring biased against a spring 59 in base 48 for pivotal and axial movement and define an axial groove 49. Spring 59 urges arms 58 towards engagement with teeth 52 of wheel 50.

Figures 5A, 5B:
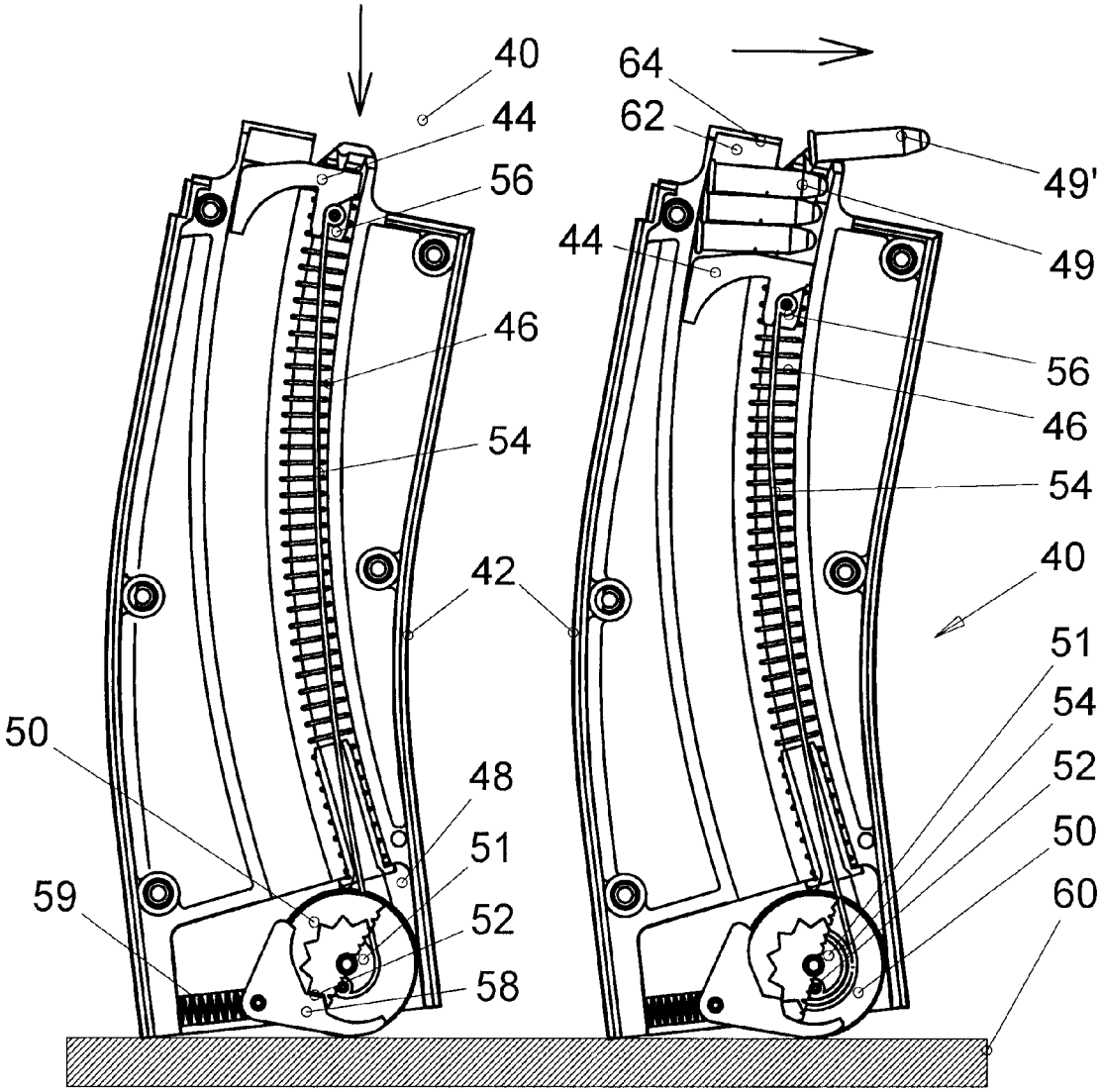
FIG. 5*a* is a sectional illustration of the magazine of FIG. 4 in a pre-loading orientation.
FIG. 5*b* is a sectional illustration of the magazine of FIG. 4 in a loading orientation while rolling the magazine forwards.

Magazine 40 is substantially similar in operation to magazine 10 of FIG. 1. FIG. 5*a* is a sectional illustration of the magazine of FIG. 4 in an empty, pre-loading orientation. As can be seen, spring 46 is substantially completely extended within housing 42. Belt 54 is affixed, at one end, to lugs 56 of follower 44, and at the other end, about wheel 50. When it is desired to load cartridges into the magazine, housing 42 is pressed down onto a surface 60, which can even be the leg of the user. When the magazine is pressed against a surface 60, surface 60 causes arms 58 to pivot into base 48 and engage teeth 52 of wheel 50.

Magazine 40 is now rolled on wheel 50 along surface 60, in the direction of the arrow shown in FIG. 5*b*. As wheel 50 rotates, belt 54 is wound around the axle 51 of wheel 50, thereby pulling follower 44 against the action of spring 46, and tensioning spring 46. As follower 44 is pulled into housing 42, an empty space 62 is formed above cartridge 64 and within lips 65 of the housing, into which additional cartridges 64' can rapidly be inserted with little or no effort. It will be appreciated that, as wheel 50 rotates, teeth 52 of wheel 50 push arms 58 outwards against the action of spring 59 moving in groove 49 and prevent engagement.

Figures 5C, 5D:
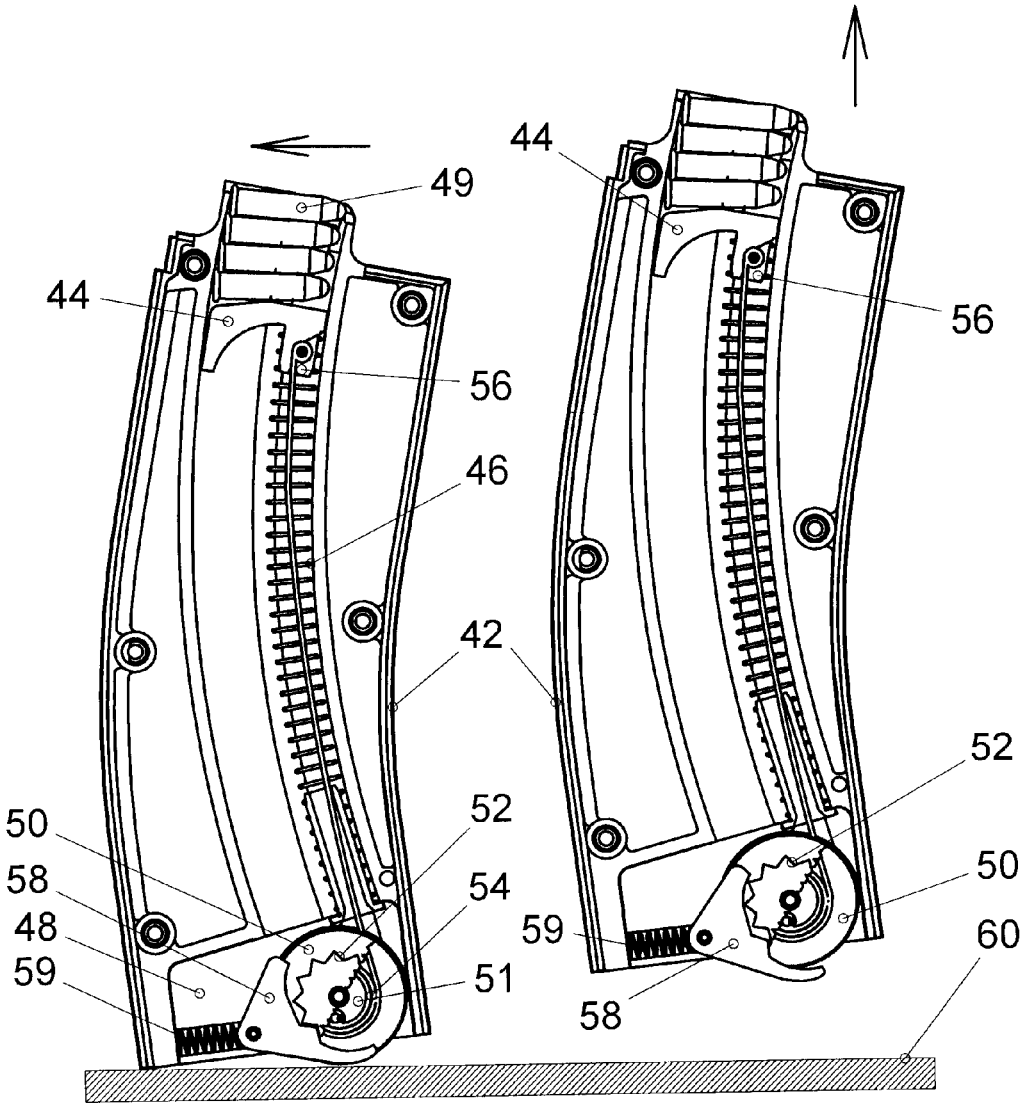
FIG. 5*c* is a sectional illustration of the magazine of FIG. 4 while rolling the magazine backwards.
FIG. 5*d* is a sectional illustration of the magazine of FIG. 4 in a loaded orientation.

In this embodiment, as well, if magazine 40 is pulled backwards along surface 60, i.e., in the opposite direction, while a user is still loading cartridges, as shown in FIG. 5*c*, spring 59 moves in axial groove 49 and urges arms 58 between teeth 52 until they engage the teeth, thereby stopping rotation of wheel 50. In this way, unwinding of belt 54 from axle 51 and the release of follower 44 are prevented.

On the other hand, belt 54 must unwind from axle 51 during firing of the firearm, so that follower 44 can urge cartridges 64 into the firearm. Accordingly, when the magazine 40 has been loaded and is raised from surface 60 into the magazine well, as seen in FIG. 5*d*, arms 58 can pivot out of base 48, and wheel 50 can rotate freely in either direction, without engaging teeth 52. Under the urging of spring 46, follower 44 will be urged upwards towards cartridges 49, unrolling belt 54 as it moves.

Figure 6A:
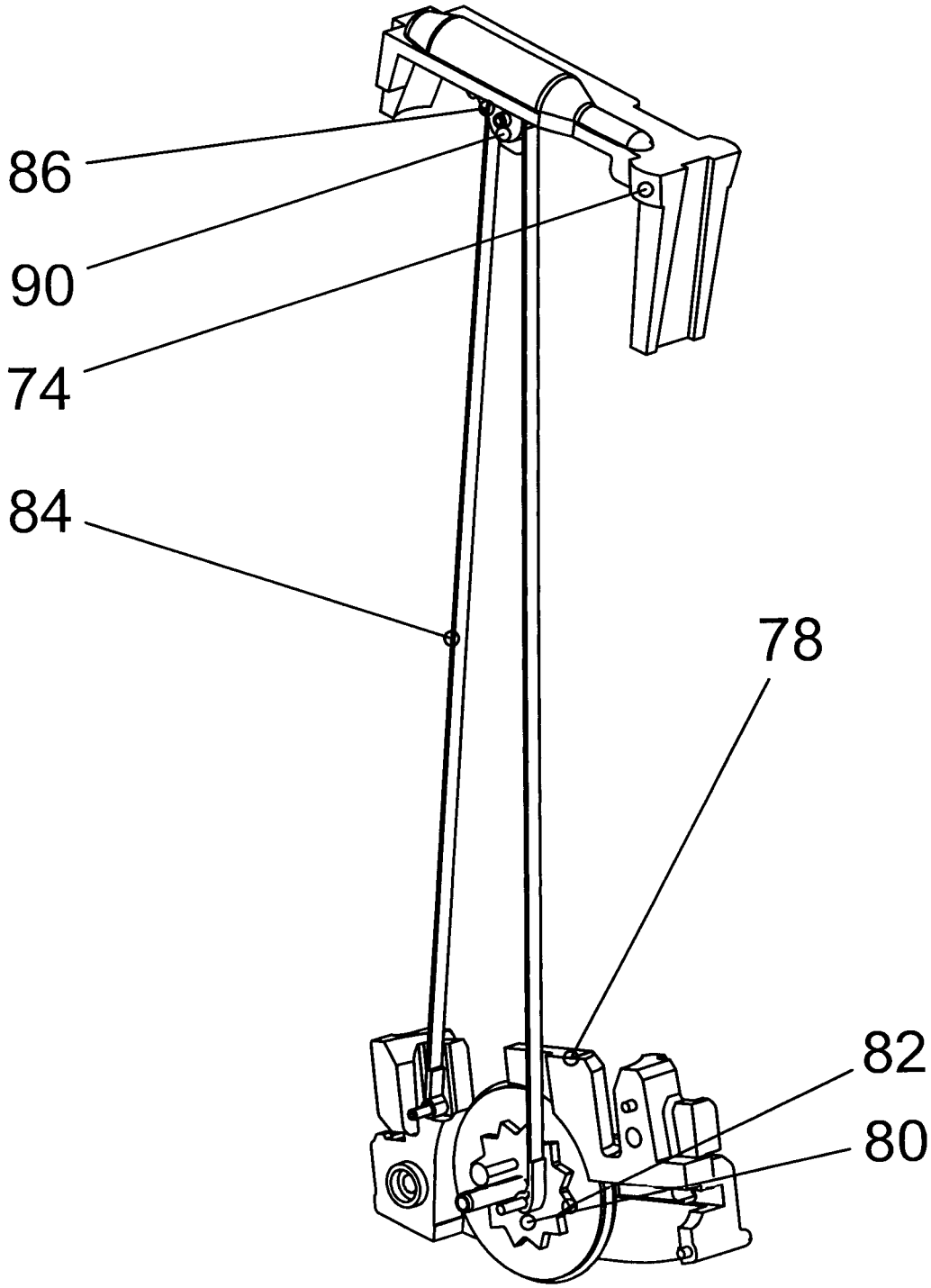
FIG. 6*a* is a side view of a portion of an ammunition magazine, constructed and operative in accordance with another embodiment of the present invention.
Figure 6B:
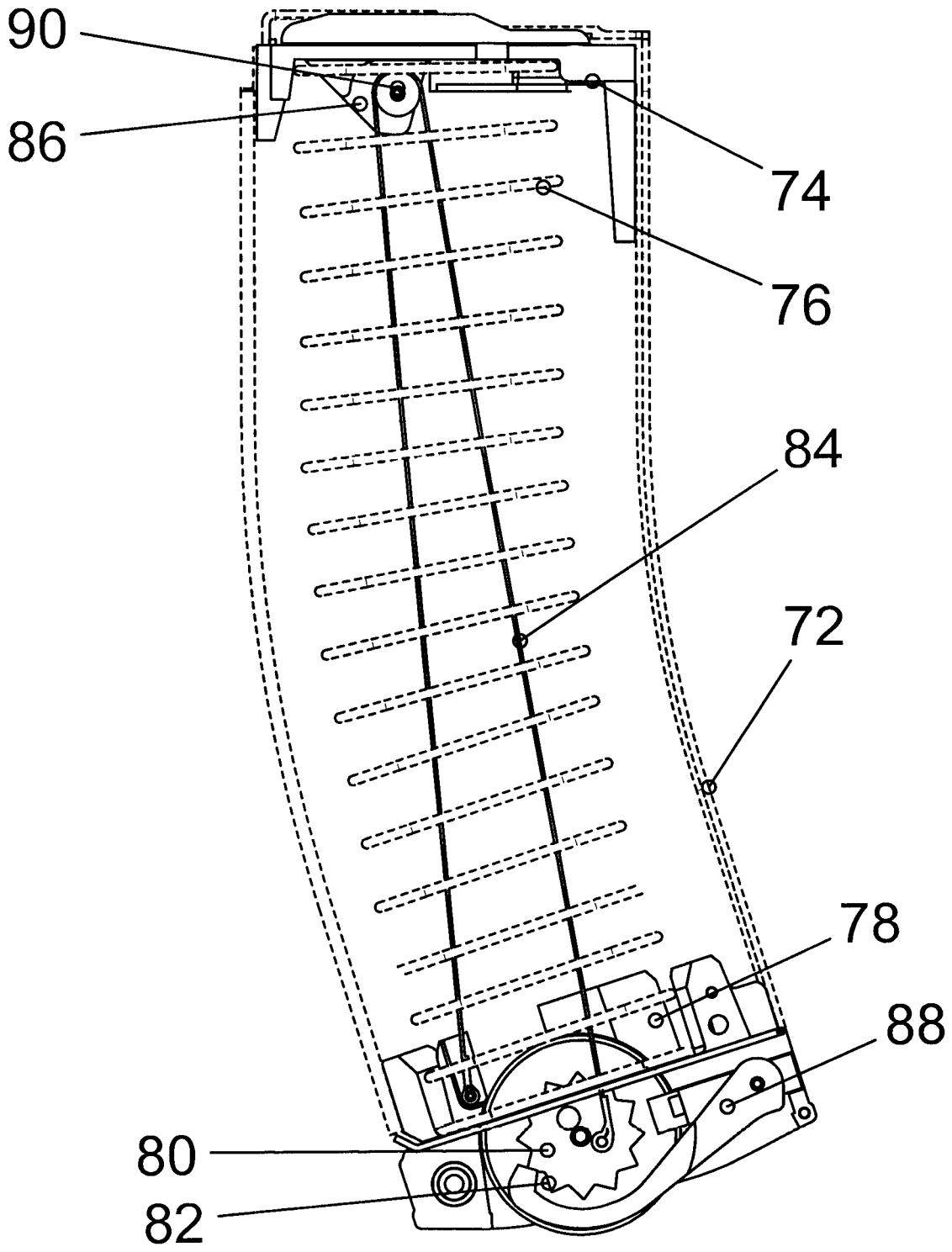
FIG. 6*b* is a sectional illustration of the magazine of FIG. 6*a*.
Figure 6C:
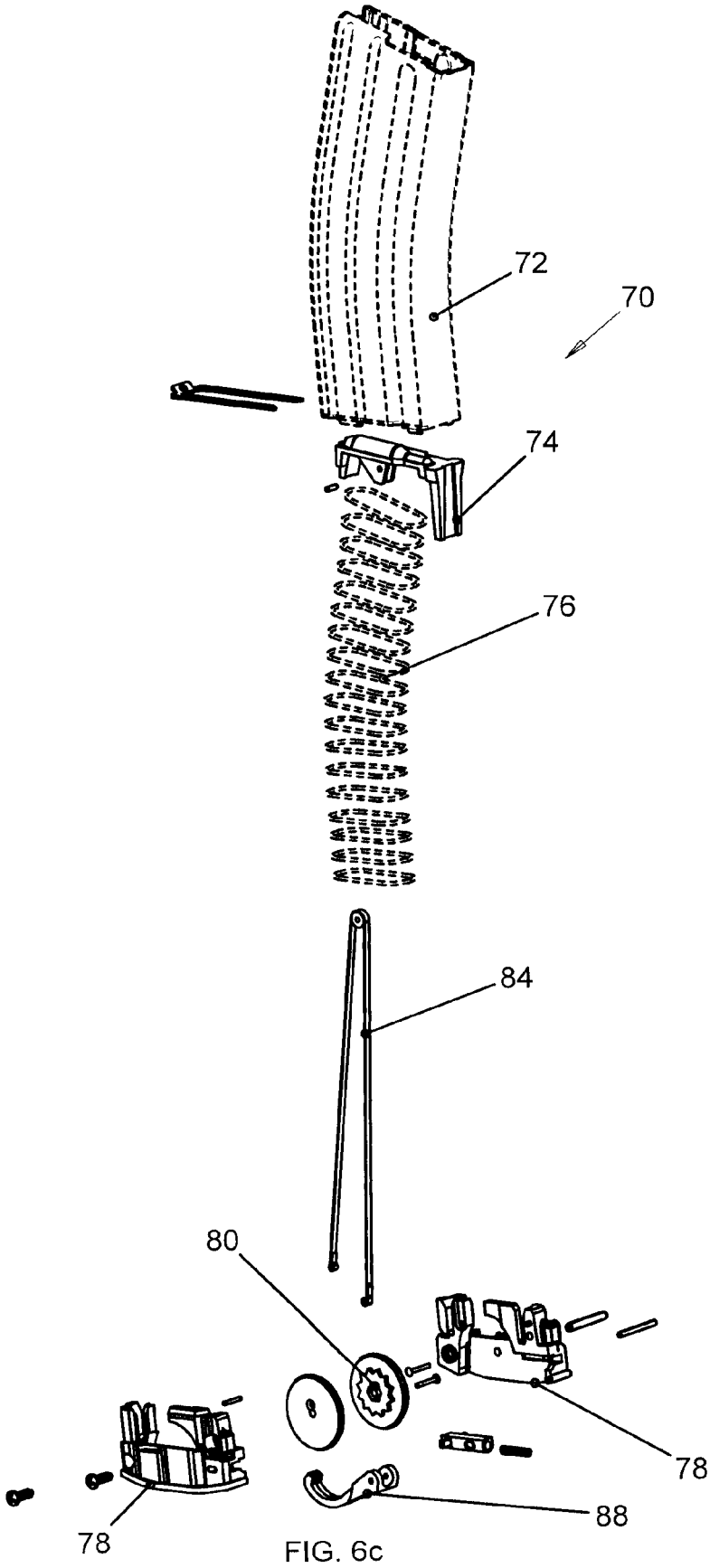
FIG. 6*c* is an exploded illustration of the magazine of FIG. 6*a*.

Referring now to FIGS. 6*a*, 6*b* and 6*c*, there are shown side, sectional and exploded views of an ammunition magazine 70, constructed and operative in accordance with a further embodiment of the present invention. As can be seen in FIG. 6*a*, magazine 70 includes a housing 72 and a follower 74 biased by a spring 76 seated on a base 78 of housing 72. Ammunition magazine 70 is similar to magazine 10 of FIG. 1 and includes a similar mechanism for collecting and releasing a belt. Thus, base 78 is removable and supports wheel 80 having a plurality of teeth 82. Magazine 70 further includes a belt 84 threaded through spring 76 and affixed to wheel 80. Belt 84 is adapted to wrap around the axle of wheel 80. Two arms 88, formed as a single unit, are spring biased in base 78 for pivotal and axial movement, as described above with reference to FIG. 1.

However, in the embodiment of FIGS. 6*a* and 6*b*, a pulley 90 is affixed to the follower 74. For example, follower 74 may include one or more depending lugs 86 to which pulley 90 is affixed. Belt 84 affixed to gear wheel or ratchet wheel 80 passes about pulley 90 and is affixed to base 78 thereby increasing the force exerted by the wheel 80.

As can be seen in FIG. 6*c*, the toothed portion of wheel 80 may be on the inside of the wheel and not on the outside, as in the embodiment in FIG. 4. Similarly, the pivoting arms 88 can be formed as a single unit, as illustrated, or as two separate arms, as in the embodiment of FIG. 1. Furthermore, the base 78 can be manufactured in two halves which are later joined together, if it is more convenient.

The operation of magazine 70 is substantially the same as operation of magazine 10 of FIG. 1. It will be appreciated that a pulley and the variations in internal parts in FIG. 6*c* can also be utilized in the same fashion in the ammunition magazine of FIG. 4 or for other types of ammunition.

It will be appreciated that belt or strap of the invention can be formed of any suitable material, including a fabric material, leather, a metal chain, a strap formed of thin steel, nylon, or any other sufficiently strong and flexible material.

While the invention has been described herein above with regard to magazines for rifles, it will be appreciated that similar adaptations can be made for pistol magazines, which are also within the scope of the present invention.

While the invention has been described with respect to a limited number of embodiments, it will be appreciated that many variations, modifications and other applications of the invention may be made. It will further be appreciated that the invention is not limited to what has been described hereinabove merely by way of example. Rather, the invention is limited solely by the claims which follow.

The invention claimed is:

1. An ammunition magazine comprising:

a housing having a base;

a follower spring-biased in said housing against said base;

a belt coupled to the follower for pulling said follower towards said base;

a mechanism in said base coupled to the belt for selectively causing the belt to pull said follower towards the base to permit freely loading of cartridges into the magazine;

said mechanism including a lockable wheel extending from the base of the magazine;

said belt being coupled to said lockable wheel for winding the belt around the lockable wheel to pull the follower towards the base when said lockable wheel rolls along a surface; and a locking element for selectably locking said lockable wheel and preventing rotation thereof.

2. The ammunition magazine according to claim 1, wherein said lockable wheel includes:

a toothed wheel mounted in said base arranged for selectable rolling along a surface;

said belt being coupled to said toothed wheel for winding the belt around the wheel to pull the follower towards the base when said toothed wheel rolls along a surface in a forward direction; and wherein said locking element includes a locking arm pivotally coupled to said base for selectably engaging teeth on said toothed wheel and preventing rotation of said wheel to unwind said belt from the wheel.

3. The ammunition magazine of claim 2, wherein said locking arm is spring-biased in said base for selectably engaging teeth of said toothed wheel so as to prevent rotation of said wheel to unwind said belt from the wheel when the base of the magazine is rolled along a surface in a rearward direction and for selectably releasing said teeth so as to permit rotation of the wheel to unwind the belt from the wheel when the base does not contact a surface.

4. The ammunition magazine of claim 1, wherein said follower includes at least one lug and said belt is affixed to said at least one lug.

5. The ammunition magazine of claim 2, further comprising a pulley mounted on said follower, one end of said belt being affixed to said toothed wheel, and a second end of said belt passing over said pulley and being affixed to said base.

6. A retrofit kit for an ammunition magazine, the kit comprising:

a replacement follower;

a replacement base for the magazine;

a belt coupled to said base and to said follower for pulling said follower towards said base; and a mechanism in said base coupled to the belt for selectively causing the belt to pull said follower towards the base to permit freely loading of cartridges into the magazine;

said mechanism including a lockable wheel extending from the base of the magazine;

said belt being coupled to said lockable wheel for winding the belt around the lockable wheel to pull the follower towards the base when said lockable wheel rolls along a surface; and a locking element for selectably locking said lockable wheel and preventing rotation thereof.

7. The kit according to claim 6, wherein said lockable wheel includes:

a toothed wheel mounted in said base for selectable rolling along a surface;

said belt being coupled to said toothed wheel for winding the belt around the wheel to pull the follower towards the base when said toothed wheel rolls along a surface in a forward direction; and wherein said locking element includes a locking arm pivotally coupled to said base for selectably engaging a tooth on said toothed wheel and preventing rotation of said wheel to unwind said belt from the wheel.

8. The kit according to claim 6, wherein said follower defines at least one lug and said belt is affixed to said lug.

9. The kit according to claim 6, wherein said follower defines at least one lug, a pulley is affixed to said lug, and one end of said belt is affixed to said lockable wheel, and a second end of said belt passes over said pulley and is affixed to said base.

10. A method for filling an ammunition magazine having a base and a spring-biased follower, a belt coupled to the follower to pull the follower towards the base, the method comprising:

applying frictional force to a lockable wheel coupled to the belt and extending from the base of the magazine;

collecting the belt around the lockable wheel by rolling the lockable wheel along a surface to cause the belt to pull the follower; and locking the lockable wheel.

11. The method according to claim 10, wherein said step of applying frictional force includes:

applying frictional force to a toothed wheel extending from said base, arranged for selectable rolling along a surface; and said step of locking includes pivoting an arm coupled to said base for selective engagement of a tooth on said toothed wheel.

12. The method according to claim 11, wherein said belt is mounted around a pulley affixed to said follower and said step of collecting includes collecting the belt around the lockable wheel after the belt has passed around the pulley.

* * * * *